US006422538B1

(12) United States Patent
Rumfield

(10) Patent No.: US 6,422,538 B1
(45) Date of Patent: Jul. 23, 2002

(54) PARTS LIFTING DEVICE

(76) Inventor: Michael Anthony Rumfield, 4009 Spring branch Rd., Montgomery, TX (US) 77316

( * ) Notice: Subject to any disclaimer, the term of this patent is extended or adjusted under 35 U.S.C. 154(b) by 0 days.

(21) Appl. No.: 09/696,250

(22) Filed: Oct. 26, 2000

Related U.S. Application Data

(60) Provisional application No. 60/162,855, filed on Nov. 1, 1999.

(51) Int. Cl.[7] ..... B66D 1/14
(52) U.S. Cl. ..... 254/343
(58) Field of Search ..... 254/323, 343, 254/352, 372, 380

(56) References Cited

U.S. PATENT DOCUMENTS 1,569,979 A * 1/1926 Hubbard ..... 254/343
1,806,482 A * 5/1931 Mellon ..... 254/343
1,833,484 A * 11/1931 Geer ..... 254/343
2,521,191 A * 9/1950 Stanland ..... 254/343
2,524,351 A * 10/1950 Jensen ..... 254/343
2,557,958 A * 6/1951 Fitzsimmons ..... 254/343
3,265,362 A * 8/1966 Moody ..... 254/343
4,613,273 A * 9/1986 Wagner ..... 254/343
5,292,011 A * 3/1994 Kostigian ..... 211/48
5,386,970 A * 2/1995 Trant ..... 254/362
5,720,400 A * 2/1998 Altizer, Sr. ..... 212/180
5,738,340 A * 4/1998 Brantner ..... 254/337
5,794,919 A * 8/1998 Hauck ..... 254/343
5,909,783 A * 6/1999 Berish ..... 182/146
6,241,215 B1 * 6/2001 Gersemsky et al. ..... 254/343

* cited by examiner

*Primary Examiner*—Emmanuel M. Marcelo
(74) *Attorney, Agent, or Firm*—Richard L. Huff

(57) ABSTRACT

A lifting device comprising a hoist with a flexible tension member extending from the hoist and a component for attaching the hoist to a stationary structure so that a lower end of the flexible tension member can be connected to a load to lift and lower the load when an impact tool engages with the hoist.

14 Claims, 4 Drawing Sheets

PARTS LIFTING DEVICE

CROSS-REFERENCE TO RELATED APPLICATIONS

This application claims the benefit of U.S. Provisional Application No. 60/162,855 filed Nov. 1, 1999.

BACKGROUND OF THE INVENTION

1. Field of the Invention

The present invention relates generally to winch and hoist apparatuses. More particularly, the invention comprises a lifting device, developed primarily for, but not limited to, the removal and installation of heavy-duty flywheels and clutches in trucks.

2. Description of the Related Art

The standard method of removing heavy truck parts such as clutches and flywheels is to manhandle them off and onto the engine or to use jacks to help with these jobs.

The first method is considered unsafe because of the weight of the flywheel or clutch and the position in which the mechanic has to install them. This method is time consuming as it requires the use of two people and, as in any lifting job, carries the threat of expensive back injuries.

While the use of a jack is safer, it is more time consuming because of the extra work necessary to make room under the truck for these bulky jacks which are commonly two to three feet wide and ten to twenty-four inches high. Because of the large size of the jacks, it is often necessary to raise the truck to get the jack and clutch assembly in position, and almost always, the complete removal of the transmission from under the truck is necessary to gain the space needed to manipulate the jack into position.

Various devices are well known in the prior art which utilize winches and hoists for lifting and pulling various objects. However, these patents are not directed to solving the problem sought to be solved by the present invention.

Winch and hoist apparatuses are shown in U.S. Pat. Nos. 5,292,011 issued to John Kostigian on Mar. 8, 1994, 5,386,970 issued to Carl Trant on Feb. 7, 1995, 5,720,400 issued to Joseph w. Altizer, Sr. on Feb. 24, 1998, 5,738,340 issued to Charles V. Brantner on Apr. 14, 1998 and 5,909,783 issued to Robert P. Berish on Jun. 8, 1999.

U.S. Pat. No. 5,292,011 to Kostigian discloses a carpet display rack for hanging room-sized carpets in show rooms. The rack has a plurality of uprights, each of which has a horizontal arm including a brace capable for supporting a hanging carpet. The arm is adapted to be raised and lowered by a cable entrained on pulleys and moved by a worm drive type winch operated by a portable drive means such as an electric drill. The cable and winch are mounted in the channel of each upright. By requiring a space-consuming pulley system, the patented system is not suitable for operating in confined spaces, such as truck engine areas.

U.S. Pat. No. 5,386,970 to Trant discloses a portable winch power drive. A power handle for rotating the capstan of a manual winch about its axis is disclosed. The handle includes a housing, a motor, a star stub for removably securing the handle to the capstan and rotating the capstan relative to the housing, a gear reduction unit for connecting the motor with the star stub, and a handle for manually securing the housing to prevent rotation of the housing relative to the axis of the capstan. The portable winch power drive of the patent is stationary and fixed in position. Thus, the winch could not be easily moved about and used in multiple areas.

U.S. Pat. No. 5,720,400 to Altizer, Sr., discloses a portable hoist device. A portable hoist is provided for lifting and moving heavy loads a short distance. The hoist has a rectangular frame which supports a movable carriage containing a winch and pulley. The rectangular frame is adjustable along comer legs which allows individual leg adjustment. Parallel longitudinal side frame members include tracks and channels for rollers to support and direct the carriage along the frame. The winch can be operated by an electric hand drill to enable an individual to move and lift several hundred pounds without assistance. While working well for the intended purpose of lifting heavy loads to and from the bed of a pickup truck, the size and weight of the hoist device of the invention would not allow it to be suitable for being easily carried around by a mechanic and installed in the engine area of a truck.

U.S. Pat. No. 5,738,340 to Brantner discloses a stirrup device and method. A stirrup device is provided which has a mounting piece to. secure a saddle, a large vehicle, or another apparatus. A drum is rotatably attached to the mounting piece. A pulley system has an attached stirrup and is operably connected to the drum for lifting and lowering the stirrup. A cable operably connects the pulley system to the drum. The drum is adapted to receive a force to rotate the drum such that, the stirrup is raised or lowered depending upon the direction of rotation of the drum. The drum may be adapted to receive a cordless electric drill for rotation of the drum. Alternatively, the drum may be secured to an electric motor or the like for imparting a rotating force on the drum. The device of the Brantner patent requires the presence of a pulley system. Thus, it would be difficult, if not impossible, for this device to operate in confined spaces, such as truck engine areas.

U.S. Pat. No. 5,909,783 to Berish discloses a motorized scaffold hoisting apparatus. Novel motorized scaffold hoisting units are provided that are intended to be used in pairs with two jack poles. Each unit comprises a carriage that is adapted to be slidably disposed on a jack pole and has guide means that restrain the carriage from moving laterally while allowing it to be raised or lowered along the length of the pole. Each unit also comprises a hoist or winch that is mounted on a platform carried by the carriage and comprises a cable-carrying drum and a power transmission for rotating the drum in response to rotative power supplied by an auxiliary electrically powered driver. The outer end of the cable carried by the drum is adapted to be releasably attached to the upper end of a jack pole on which the unit is mounted. Each carriage also carries at least two fail-safe brake means for releasably gripping the pole on which the carriage is mounted, and means in the form of a laterally-projecting arm for supporting a scaffold, e.g., a wooden or aluminum plank. Each transmission is adapted to be driven by an electrically powered driver, e.g., a battery-powered electric drill fitted with a socket wrench that mates with the input shaft of the power transmission. The great size and weight of each hoisting unit would prohibit a mechanic from carrying the hoist unit around to be used when necessary. Also, the hoist units could not be used in the confined spaces of truck engines.

The present invention is completely different than these patents in that it consists of a hoist which is no more than about ten pounds in weight and has a size of about 5" thick, 6" tall, and 7" wide. The hoist is attached to the top of a flywheel housing in a truck with a special mounting component. The hoist includes a flexible tension member extending therefrom, which can lift and lower a flywheel or clutch assembly when a mechanic operates an impact tool that is in engagement with a worm gear screw drive unit in the hoist.

SUMMARY OF THE INVENTION

The present invention is intended to provide a parts lifting device which overcomes the handicap of large size and weight while still providing sufficient lifting power to be useful for lifting and moving heavy truck pieces. The parts lifting device of this invention is small and light enough to easily be carried about by a mechanic, yet is powerful enough to be able to lift heavy truck parts. The device of the present invention enables one mechanic, instead of two, to lift and move large truck parts. This is accomplished while eliminating the dangerous task of manually lifting heavy truck parts. This device eliminates the necessity for making room under a truck for bulky jacks.

The present invention is a lifting device that consists of a hoist having a slack adjuster and a worm gear screw drive unit, which turns a drive shaft with a flexible tension member extending therefrom. A mounting plate attaches the hoist to the top of a flywheel housing in a truck, so that the flexible tension member can be affixed at a bottom end to a flywheel or clutch assembly. An air or electric impact tool in contact with the worm gear screw drive unit when operated, will cause the drive shaft to rotate, allowing the flexible tension member to lift and lower the disassembled flywheel or clutch assembly.

The invention is simple, easy to use and is economical to manufacture. The invention provides improved elements and arrangements thereof in an apparatus for the purposes described which is inexpensive, dependable and fully effective in accomplishing its intended purposes with increased safety.

Other objects, advantages and capabilities of the invention will become apparent from the following description taken in conjunction with the accompanying drawings showing the preferred embodiment of the invention.

DESCRIPTION OF THE PREFERRED EMBODIMENT

Figure 1:
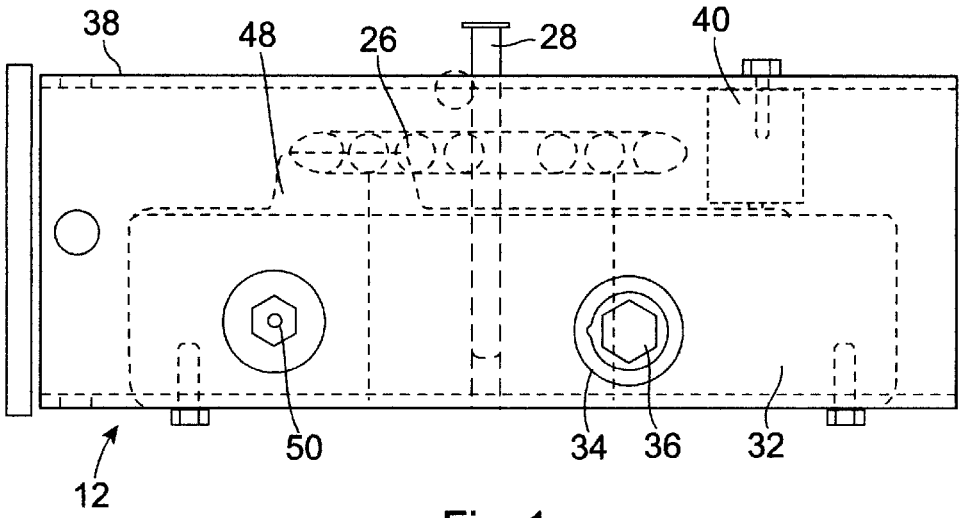
FIG. 1 is a front elevational view of the hoist.
Figure 2:
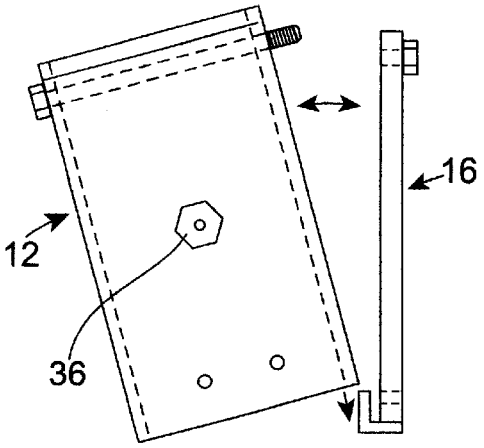
FIG. 2 is a side elevational view showing the hoist being attached to the mounting bracket.

For a fuller understanding of the nature and desired objects of the invention, reference should be made to the following detailed description taken in connection with the accompanying drawings. Referring to the drawings wherein like reference numerals designate corresponding parts throughout the several figures, reference is made to FIGS. 1 through 7 which illustrate various components of the present invention being a lifting device 10 comprising a hoist 12, with a flexible tension member 14 extending from the hoist 12. An attaching component 16 of the lifting device 10 is for attaching the hoist 12 to a stationary structure 18 so that a lower end 20 of the flexible tension member 14 can be connected by a spicer clutch attaching bolt and bolt lock 22 to a load 24, to lift and lower the load 24, when an impact tool (not shown) engages the hoist 12.

Figure 6:
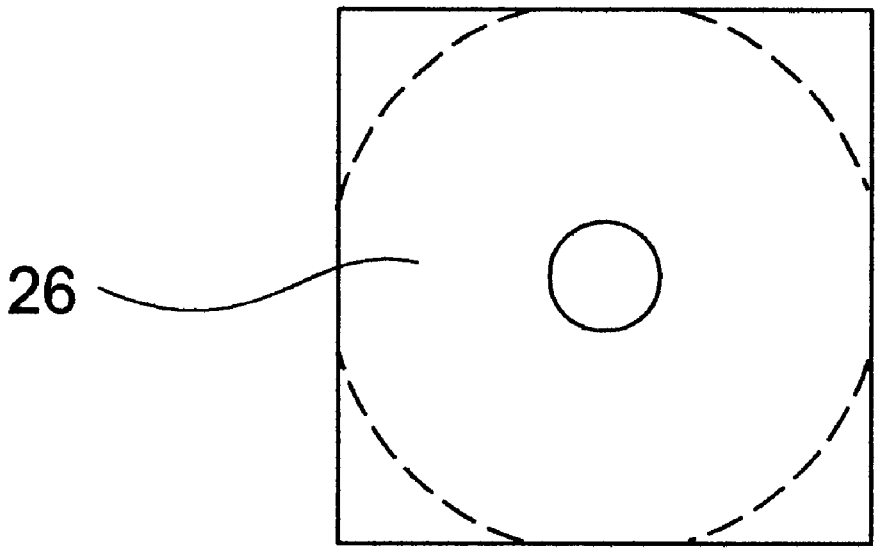
FIG. 6 is an elevational view showing a square sprocket for engaging a chain.
Figure 7:
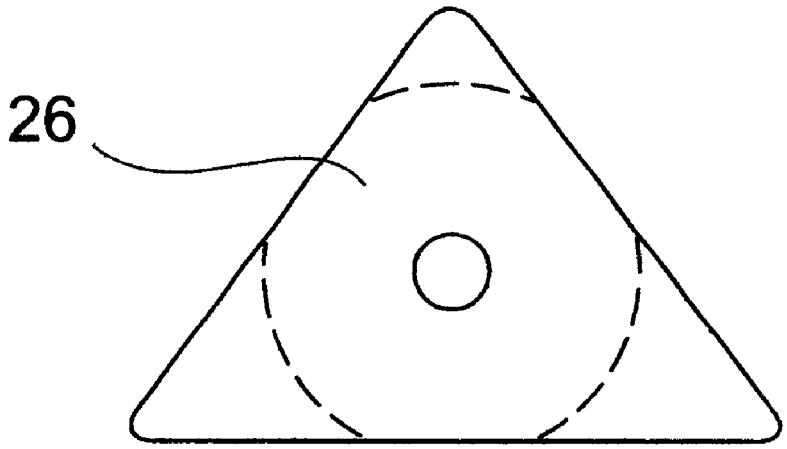
FIG. 7 is an elevational view showing a triangular sprocket for engaging a chain.

The flexible tension member 14 can be a chain, cable, wire or strong rope. When the flexible tension member 14 is a chain, the chain 14 is engaged on a sprocket wheel 26 which is splined onto the drive shaft 28. The lower end 20 of the chain 14 attaches to the spicer clutch attaching bolt and bolt lock 22 and the other end of the chain 14 hangs freely from the chain sprocket wheel 26. The sprocket wheel 26 may be round as in conventional wheels, or it may take the form of other shapes as shown in FIG. 6.

When the flexible tension member 14 takes another form, such as cable, wire, or rope, no sprocket wheel 26 is necessary. The lower end 20 of the flexible tension member 14 attaches to the spicer clutch attaching bolt and bolt lock 22 by way of an eye end 30 and the other end is attached to the drive shaft 28 through a hole (not shown) in the drive shaft 28 and the flexible tension member 14 winds around the drive shaft 28.

The stationary structure 18 can be a flywheel housing in a truck, while the load 24 can be a clutch assembly or a flywheel in the truck.

Figure 5:
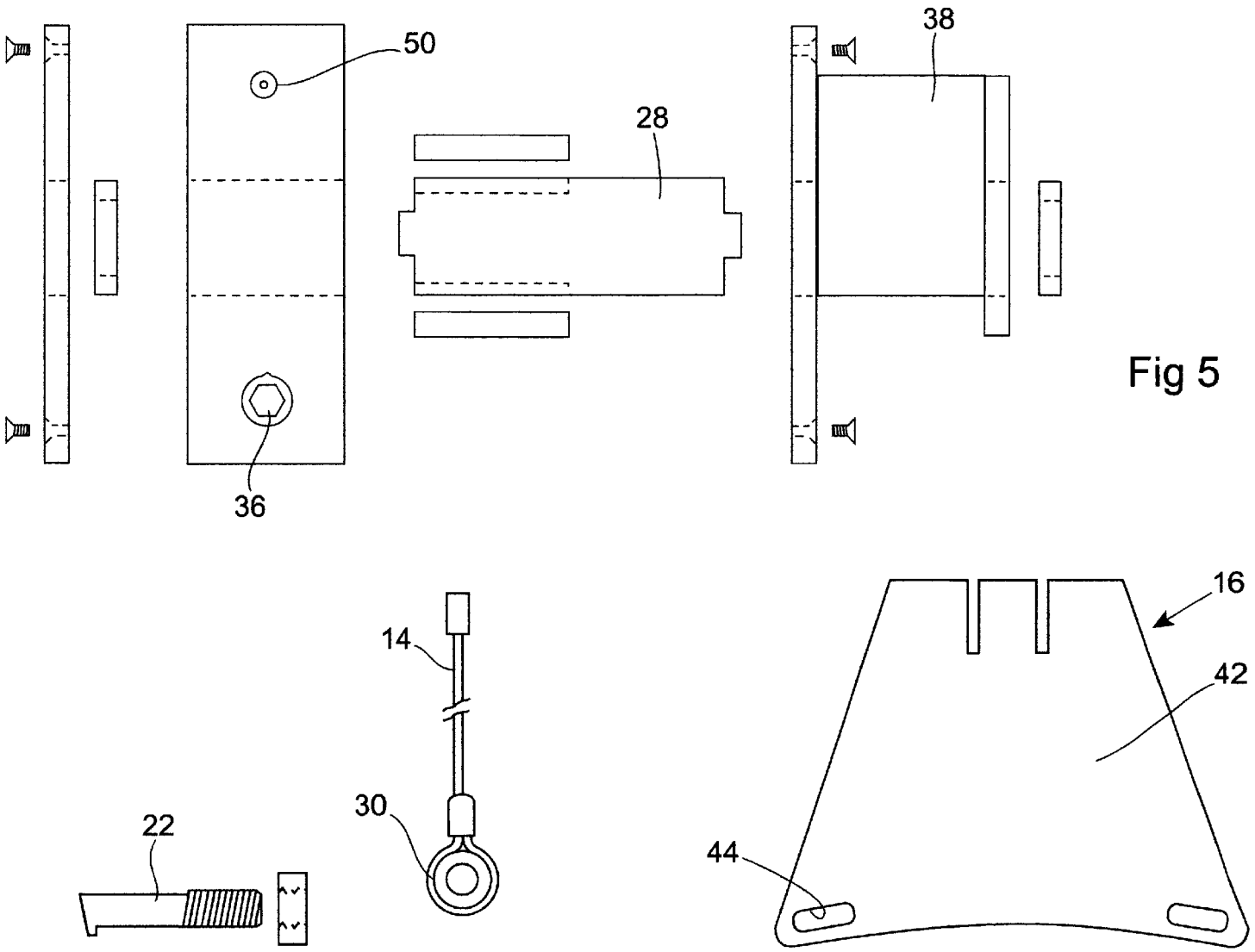
FIG. 5 is a diagrammatic exploded view of the hoist and mounting bracket.

The hoist 12, as best seen in FIGS. 1 and 5, includes a slack adjuster 32. A worm gear screw drive unit 34 is in the slack adjuster 32. For protection, the slack adjuster 32 has a slack adjuster cover 48. Also, the hoist 12 contains a grease fitting 50. to allow for proper lubrication. A socket 36 is on a free end of the worm gear screw drive unit 34. A drive shaft 28 is coupled to the worm gear screw drive unit 34 so that when the impact tool engages the socket 36 to operate the worm gear screw drive unit 34, the flexible tension member 14 will be raised or lowered according to the direction the drive shaft 28 is turned.

Figure 3:
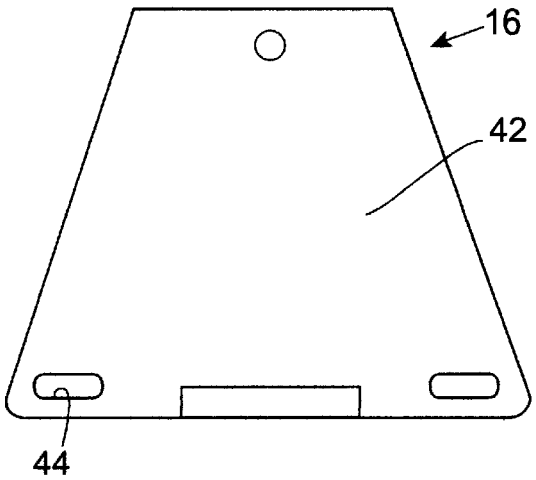
FIG. 3 is a front elevational view of the mounting bracket.
Figure 4:
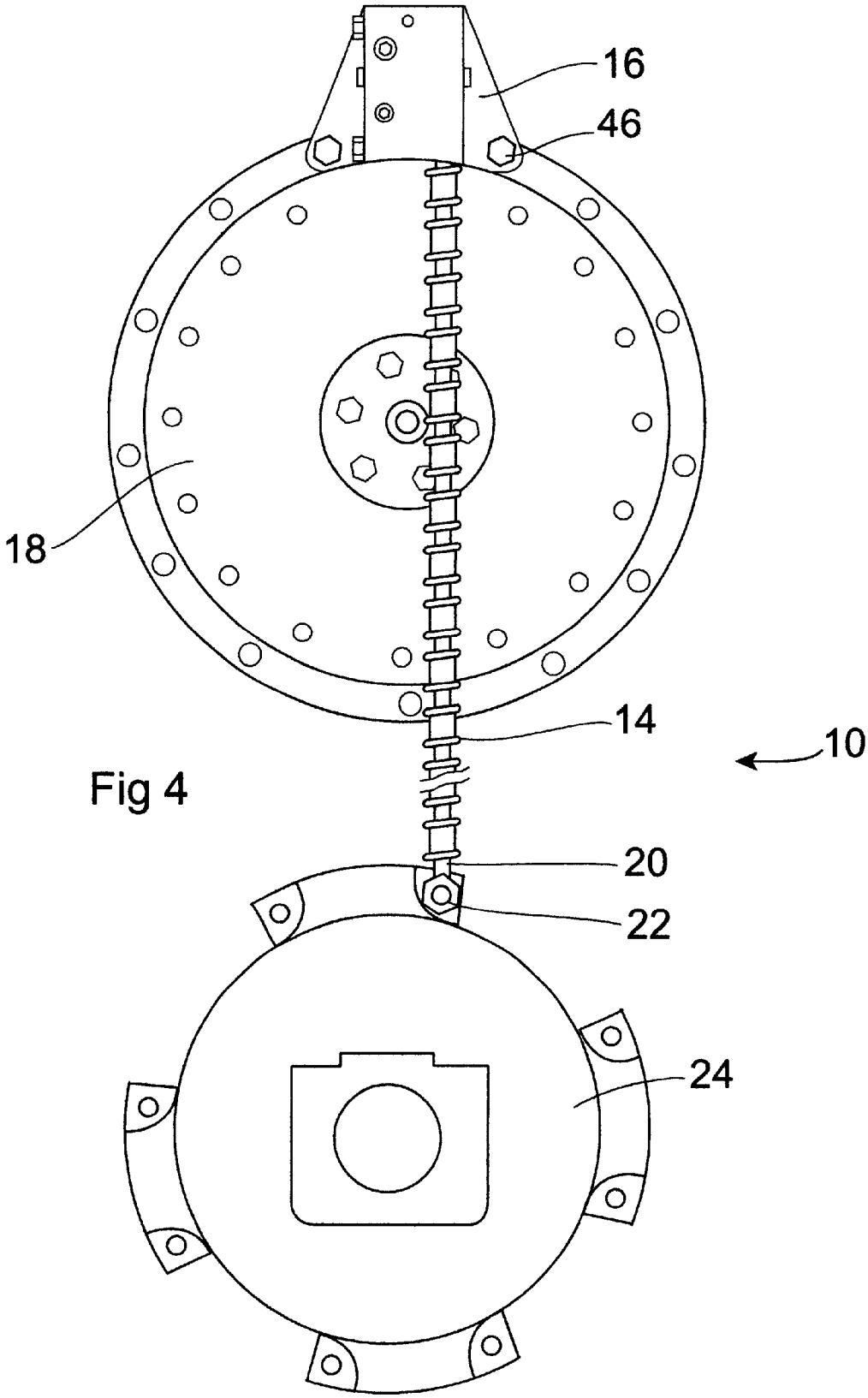
FIG. 4 is a front elevational view showing the present invention in use.

A housing 38 and a roller chain guide 40 can also be provided in the hoist 12. The attaching component 16, as best seen in FIG. 3, comprises a mounting bracket 42 having slotted holes 44 to allow the mounting bracket 42 to be bolted, via bolts 46, to the stationary structure 18 so that the hoist 12 can be affixed to the mounting bracket 42. Alternatively, the attachment component 16 can be so made as to simply slip over the stationary structure 18 To use the lifting device 10 for lifting and lowering the load 24 the following steps should be taken:

1. attach the mounting bracket 42 to the stationary structure 18;
2. affix the hoist 12 to the mounting bracket 42;
3. connect the lower end 20 of the flexible tension member 14, which extends from the drive shaft 28 coupled to the worm gear screw drive unit 34 in the slack adjuster 32 in the hoist 12, to the load 24;
4. place the impact tool into a drive engagement with the socket 36 of the worm gear screw drive unit 34;
5. actuate the impact tool to operate the worm gear screw drive unit 34 to rotate the drive shaft 28 in a first direction, whereby the flexible tension member 14 will wind about the drive shaft 28 or sprocket wheel 26 to lift the load 24;
6. activate the impact tool to operate the worm gear screw drive unit 34 to rotate the drive shaft 28 in a second direction, the second direction being opposite from the first direction, whereby the flexible tension member 14 will unwind from the drive shaft 28 to lower the load 24; and
7. disconnect the impact tool from the socket 36 of the worm gear screw drive unit 34.

The foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A lifting device comprising:

i) a hoist comprising a slack adjuster, a worm gear screw drive unit in the slack adjuster, a socket on a free end of the worm gear screw drive unit, and a drive shaft coupled to the worm gear screw drive unit;

ii) a flexible tension member extending from the hoist; and iii) means for attaching the hoist to a stationary structure, so that a lower end of the flexible tension member can be connected to a load to lift and lower the load when the socket is turned to operate the worm gear screw drive unit.

2. The lifting device of claim 1, wherein the attaching means is a mounting bracket having slotted holes to allow the mounting bracket to be bolted to the stationary structure so that the hoist can be affixed to the mounting bracket.

3. The lifting device of claim 2 mounted on a flywheel housing of a truck.

4. The lifting device of claim 1, wherein the attaching means is so formed as to slip over the stationary structure.

5. The lifting device of claim 4 mounted on a flywheel housing of a truck.

6. The lifting device of claim 1, wherein the flexible tension member is a chain and the drive shaft is equipped with a sprocket wheel.

7. The lifting device of claim 6 mounted on a flywheel housing of a truck.

8. A method of lifting a load with the lifting device recited in claim 6, comprising the steps of:

attaching the mounting bracket to a stationary structure;

affixing the hoist to the mounting bracket;

connecting a lower end of the flexible tension member to the load; and turning the socket to rotate the drive shaft in a first direction, whereby the chain will be rotated about the sprocket wheel and lift the load.

9. The lifting device of claim 1, wherein the flexible tension member is a cable.

10. The lifting device of claim 9 mounted on a flywheel housing of a truck.

11. A method of lifting a load with the lifting device recited in claim 9, comprising the steps of:

attaching the mounting bracket to a stationary structure;

affixing the hoist to the mounting bracket;

connecting a lower end of the flexible tension member to the load; and turning the socket to rotate the drive shaft in a first direction, whereby the cable will be rotated about the drive shaft and lift the load.

12. The method of claim 11, wherein the load is a clutch and the stationary structure is a flywheel housing of a truck.

13. The lifting device of claim 1 mounted on a flywheel housing of a truck.

14. A method of lifting and lowering a load with the lifting device recited in claim 1, comprising the steps of:

attaching the mounting bracket to a stationary structure;

affixing the hoist to the mounting bracket;

connecting a lower end of the flexible tension member to the load; and turning the socket to rotate the drive shaft in a first direction, whereby the flexible tension member will lift the load.

* * * * *